US006595500B2

(12) United States Patent
Osburg et al.

(10) Patent No.: US 6,595,500 B2
(45) Date of Patent: Jul. 22, 2003

(54) MEMBRANE CARBURETOR

(75) Inventors: Gerhard Osburg, Stetten (DE); Wolfgang Luithardt, Waiblingen (DE); Peter Schmidt, Waiblingen (DE); Reinhard Gerhardy, Korb (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 10/127,496

(22) Filed: Apr. 23, 2002

(65) Prior Publication Data

US 2002/0158349 A1 Oct. 31, 2002

(30) Foreign Application Priority Data

Apr. 25, 2001 (DE) ..... 101 20 127

(51) Int. Cl.[7] ..... F02M 7/08

(52) U.S. Cl. ..... 261/34.2; 261/35; 261/69.1; 261/DIG. 8; 261/DIG. 68

(58) Field of Search ..... 261/34.2, 35, 69.1, 261/69.2, DIG. 8, DIG. 68

(56) References Cited

U.S. PATENT DOCUMENTS 3,404,872 A * 10/1968 Nutten ..... 261/34.2
3,575,388 A * 4/1971 Scarr, Jr. ..... 261/34.2
3,811,417 A 5/1974 Keenan et al. ..... 55/DIG. 28
4,834,784 A 5/1989 Bidanset ..... 55/385.7
4,838,909 A 6/1989 Bidanset ..... 55/385.7
4,877,560 A * 10/1989 Kenny et al. ..... 261/35
5,250,233 A * 10/1993 Swanson ..... 261/34.2
5,711,901 A * 1/1998 Berg et al. ..... 261/35
6,234,458 B1 * 5/2001 Gerhardy ..... 261/71
6,293,524 B1 * 9/2001 Endo et al. ..... 261/34.2
6,354,571 B1 * 3/2002 Gerhardy ..... 261/35
6,425,573 B1 * 7/2002 Suzuki ..... 261/35

FOREIGN PATENT DOCUMENTS

FR 2567199 1/1986
GB 14085 6/1914

* cited by examiner

*Primary Examiner*—Richard L. Chiesa
(74) *Attorney, Agent, or Firm*—Walter Ottesen

(57) ABSTRACT

A membrane carburetor for an internal combustion engine in a portable handheld work apparatus includes a control chamber (3) delimited by a membrane (2). The control chamber (3) is connected via a feed line (4) to a fuel tank (5). The feed line (4) is cleared via a valve body (6) when there is a deflection of the membrane (2) because of an underpressure in the control chamber (3). The control chamber (3) is connected to an air channel (10) via at least one fuel nozzle (7) and at least one ancillary chamber (9). The air channel (10) passes through the membrane carburetor (1) and leads to the internal combustion engine. A purge pump (11) is provided in a fuel line (12) connecting the control chamber (3) to the fuel tank (5). The fuel path between the control chamber (3) and the purge pump (11) is guided through at least one ancillary chamber (9).

15 Claims, 4 Drawing Sheets

MEMBRANE CARBURETOR

BACKGROUND OF THE INVENTION

Portable handheld work apparatus such as chain saws, brushcutters, suction/blower apparatus or the like and equipped with an internal combustion engine as a drive motor include, as a rule, a membrane carburetor for forming an air/fuel mixture for the engine. In the membrane carburetor, a control chamber is provided, which is delimited by a membrane and is connected via a feed line to a fuel tank. A valve body is mounted in the feed line which clears the latter in response to a deflection of the membrane because of an underpressure in the control chamber. With an arrangement of this kind, fuel is continuously supplied in dependence upon the fuel quantity inducted via fuel nozzles in the carburetor and taken from the control chamber. At standstill of the engine, the induction underpressure is not present in the region of the fuel nozzles and therefore there is no flow of fuel through the nozzles into the intake channel. A pressure equalization in the control chamber accompanies standstill whereby the valve body is closed via the membrane and therefore an uncontrolled afterflow of fuel is avoided.

After a longer standstill of the carburetor, an at least partial emptying of the control chamber can occur because of vaporization processes or the like and this can lead to starting difficulties of the engine. The control chamber can be flooded with fuel by means of a suitable purge pump; however, undefined start conditions for the mixture formation can nonetheless occur.

SUMMARY OF THE INVENTION

It is an object of the invention to provide a membrane carburetor having improved starting characteristics for the internal combustion engine.

The membrane carburetor of the invention is for an internal combustion engine in a portable handheld work apparatus including a motor-driven chain saw, cutoff machine and brushcutter. The engine has a fuel tank and the membrane carburetor includes: a carburetor housing defining an intake channel communicating with the engine and through which a stream of combustion air flowing in an intake flow direction is drawn by suction when the engine is operating; the carburetor housing defining an interior space; a control membrane mounted in the interior space so as to define a control chamber therein bounded by the control membrane; a fuel supply line connecting the fuel tank to the control chamber; a control valve mounted in the fuel supply line and being actuable to control the inflow of fuel to the control chamber; the control membrane being operatively connected to the control valve for actuating the control valve to clear the fuel supply line in response to a deflection of the control membrane whereby fuel flows into the control chamber; at least one fuel nozzle; an ancillary chamber disposed in the carburetor housing; a fuel path connecting the control chamber to the fuel tank; a purge pump mounted in the fuel path; the control chamber being connected to the intake channel via the ancillary chamber and the fuel nozzle; the fuel path including a segment thereof between the control chamber and the purge pump; and, the fuel path being so configured that the segment thereof passes through the ancillary chamber.

With the above, a membrane carburetor is so configured that the fuel path between the control chamber and the purge pump is taken through at least one ancillary chamber communicating with the control chamber. In this way, it is ensured that vapor or air bubbles, which are possibly present in the ancillary chamber, can be purged with the purge pump. These vapor bubbles can lead, for example, to an uneven flow of the fuel through the fuel nozzle into the air channel of the carburetor and possible disadvantageous effects from the compressibility of such vapor bubbles are reliably avoided in this manner. The ancillary chamber can be in the form of a main nozzle chamber connected ahead of the main nozzle and, with an ancillary chamber having this form, fuel is made available in the direct proximity of the main nozzle via the purging operation so that fuel is available in the main nozzle at the beginning of the starting operation. A removal of fuel vapor, air or the like via suction through the main nozzle, which lengthens the starting operation, is thereby not present. With an arrangement of a check valve in the main nozzle chamber, a stickiness or gumming of the valve platelet, which is caused by a drying out, can be avoided or dissolved via a rinsing with fuel.

With an ancillary chamber in the form of a pump chamber of an accelerator pump, the pump chamber can be filled with fuel via a purging operation in advance of starting the engine. In this way, fuel is already available in the accelerator pump at the beginning of the starting operation. An engine, which runs unevenly in the starting phase, can be additionally supplied with fuel by actuating the throttle flap and the accelerator pump, which communicates with the throttle flap, in that fuel is injected into the air channel via a fuel nozzle. This achieves a short-term enrichment of the air/fuel mixture in the carburetor and facilitates a starting of the engine even under difficult climatic conditions. With an arrangement of several ancillary chambers (especially the primary nozzle chamber and the pump chamber), these chambers are advantageously flow-conductingly connected in series to the purge pump. With a purging operation, the ancillary chambers are sequentially purged and the discharge of vapor bubbles or air bubbles is ensured. With a flow-conducting parallel connection of two or more ancillary chambers or even one ancillary chamber to the control chamber, these chambers can be effectively thoroughly purged while avoiding an interaction with each other.

In a practical embodiment, the purge pump is configured as a suction pump acting on the control chamber and is mounted in a return line to the fuel tank. A purging operation is made possible especially in combination with check valves mounted in the region of the ancillary chambers and operating on the corresponding fuel nozzle with this purging operation reliably eliminating vapor bubbles and avoiding a premature discharge of fuel via the fuel nozzles. The check valves prevent an unwanted induction of air via the fuel nozzles.

In an advantageous further embodiment, the valve body, which is actuated by the membrane, is mounted laterally in the membrane carburetor. The fuel path connects the control chamber to the fuel tank and a segment of the fuel path is between the control chamber and the purge pump. On the same side of the carburetor, a portion of this segment of the fuel path is provided, which connects the ancillary chamber to the purge pump whereby, overall, a space-saving configuration is made possible and conventional carburetors can be replaced with an embodiment according to the invention while retaining the external measurements.

The purge pump advantageously has an elastically depressible pump bellows, which is preferably transparent and via which the control chamber with the connected ancillary chambers can be thoroughly purged with a thumb or a finger. The elastic pump bellows is at least approximately free of wear and permits the user to reliably determine whether bubble-containing fuel is pumped during the purging operation. The purging of pure fuel can be reliably seen whereby a conclusion can be drawn as to an adequate purging of the control chamber and the connected ancillary chambers.

The purge pump advantageously has a valve arrangement with at least one duckbill valve and advantageously includes a suction valve and a pump valve which operate alternately. The pressure valve, which is configured as a duckbill valve, seals the fuel line with two elastic mutually adjacent sealing lips even when there is no external counterpressure. A high resistance to wear is provided by the omission of mechanically movable valve bodies. The induction valve for inducting fuel from the control chamber is advantageously configured as a valve having a valve plate. Especially in combination with the elastic depressible pump bellows and its relatively low suction forces, the large surface of the valve plate leads to an opening of the suction valve even for a slight pressure difference and therefore leads to a high throughflow rate during induction.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
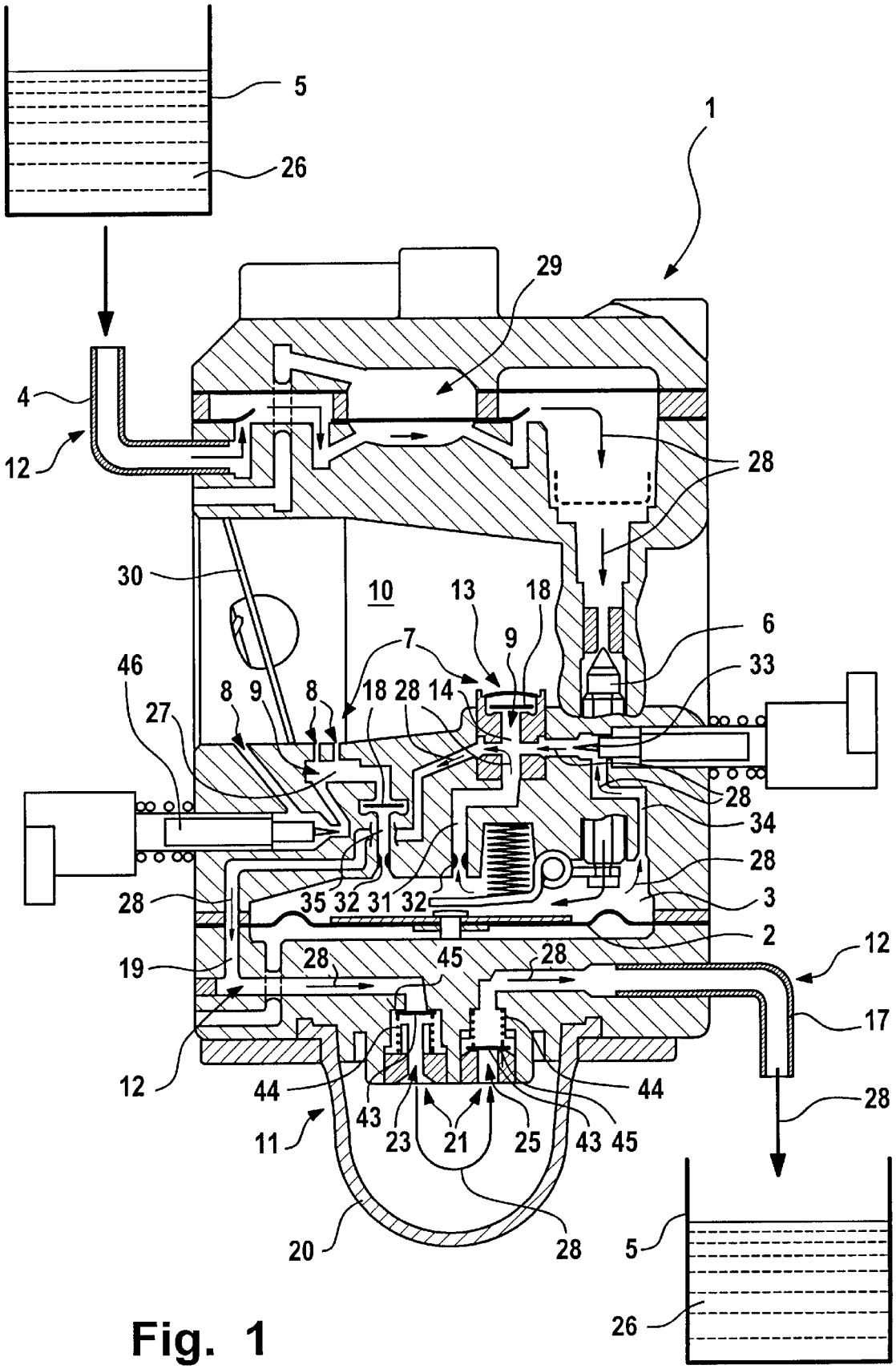
FIG. 1 is a longitudinal section view through a carburetor having a fuel path which leads from the control chamber of the carburetor through the main nozzle chamber to the purge pump.

FIG. 1 shows a membrane carburetor 1 for supplying an internal combustion engine (not shown) in a portable hand-held work apparatus with an air/fuel mixture. A membrane pump 29 is mounted in the carburetor 1 and draws fuel 26 from a fuel tank 5 via a feed line 4. A control chamber 3, which is delimited by a membrane 2, is provided on the side of the carburetor 1 lying opposite the membrane pump 29. The feed line 4 opens into the control chamber 3 and this feed line 4 can be closed or cleared via a valve body 6 actuated by the membrane 2. An air channel 10 leads to the engine and extends through the carburetor 1. A number of fuel nozzles 7 open into the air channel 10 and fuel 26 is drawn by suction into the air channel 10 for forming an air/fuel mixture. A throttle flap 30 is mounted in the air channel 10 and is pivotally journalled for controlling the throughflow quantity of the air/fuel mixture and therefore for controlling the power of the engine.

In the embodiment shown, the fuel nozzles 7 comprise three idle nozzles 8 arranged in the region of the throttle flap 30 as well as a main nozzle 13 for supplying fuel in the part-load and full-load ranges. Ancillary chambers 9 are assigned to corresponding ones of the fuel nozzles 7. In the embodiment shown, the ancillary chambers 9 are arranged forward of the main nozzle 13 and the idle nozzles 8, respectively. Respective check valves 18 are provided in the region of the ancillary chambers 9 for preventing a backflow of fuel or air through the fuel nozzles 7. The main nozzle 13 is flow-conductively connected via a main channel 31 having a throttle 32 to the control chamber 3. An ancillary channel 34 is connected in parallel to the main channel 31 and the ancillary channel 34 can be adjusted via a nozzle needle 33 with respect to its throughflow quantity. The idle nozzles 8 are connected to the control chamber 3 via an idle channel 35 having a throttle 32 mounted therein.

The idle nozzles 8 lie upstream and downstream of the throttle flap 30 which is shown in the idle position. Air enters into the idle chambers 27 via two idle nozzles 8 lying upstream of the throttle flap 30 and forms an emulsion with the fuel entering via the fixed throttle 32. The emulsion is supplied via an adjustable idle nozzle needle 46 to the idle nozzle 8 lying downstream of the throttle flap 30. The emulsion exits from the idle nozzle 8 into the intake channel. When the throttle flap 30 opens, additional idle nozzles lie in the intake region so that emulsion then also exits therefrom. With a wide opening of the throttle flap 30, all idle nozzles 8 lie in the induction region so that fuel now discharges from all idle nozzles 8. The maximum quantity of the fuel is delimited by the fixed throttle 32.

The feed line 4 is closed by the valve body 6 in the rest position. An underpressure develops in the control chamber 3 with an induction of fuel 26 from the idle nozzles 8 and the main nozzle 13 into the air channel 10. This underpressure leads to a deflection of the membrane 2 and therefore to a clearing of the feed line 4 by the valve body 6 connected to the membrane 2.

The control chamber 3 is connected to the fuel tank 5 via fuel line 12 in the form of a return line 17. A purge pump 11 is mounted in the return line 17 and this purge pump includes an elastically depressible pump bellows 20 as well as a valve arrangement 21 having reciprocally operating induction and discharge valves (23, 25). The induction and discharge valves (23, 25) comprise essentially valve seats 45 against which respective valve platelets 43 are pressed via corresponding ones of springs 44. With an alternative pressing and relaxation of the pump bellows 20, the content of the pump bellows 20 is emptied into the tank 5 via the pressure valve 25 and the return line 17 or fuel 26 as well as possibly present gas bubbles are drawn by suction from the control chamber 3 via the induction valve 23. In this arrangement, the purge pump 11 operates as a suction pump on the control chamber 3. The segment 19 of the return line 17 lies between the purge pump 11 and the control chamber 3 and is led from the control chamber 3 through the main nozzle chamber 14 and, from there, to the purge pump 11. It can also be practical to lead the segment 19 through the idle nozzle chamber 27 and especially also in combination with the main nozzle chamber 14. Here, a parallel connection as well as a series connection of the individual ancillary chambers 9 can be advantageous.

In the embodiment shown, fuel 26 is drawn by suction from the fuel tank 5 through the feed line 4, the membrane pump 29 and past the valve body 6 in the direction of arrows 28 and into the control chamber 3 by actuating the purge pump 11. From there, the fuel 26 is conveyed in the direction of arrows 28 together with possibly present gas bubbles through the main nozzle chamber 14, the valve arrangement 21 and the return line 12 back into the fuel tank 5. The main nozzle chamber 14 is purged in parallel via the main channel 31 and the ancillary channel 34. An arrangement of the purge pump 11 as a discharge pump can be practical in the fuel line 12 configured as feed line 4.

In the region of the valve body 6, the feed line 4 extends through the carburetor 1 at the side of the carburetor lying opposite the throttle flap 30. The segment 19 of the return line 17 between the control chamber 3 and the purge pump 11 is advantageously mounted on the same side but, for the sake of clarity, is shown in the carburetor 1 on the side of the throttle flap 30.

Figure 2:
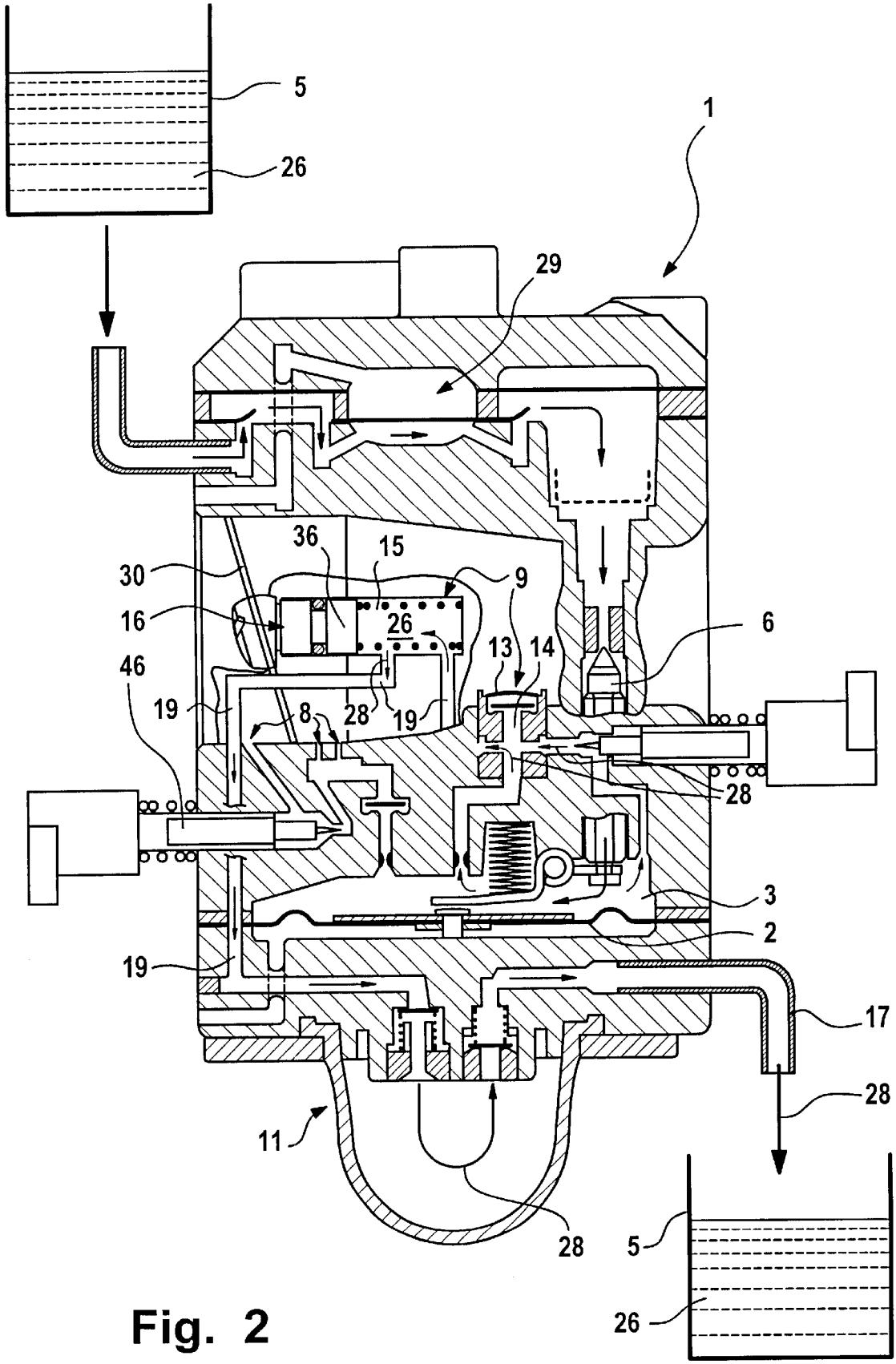
FIG. 2 is a variation of the arrangement shown in FIG. 1 and has an accelerator pump which can additionally be purged.

FIG. 2 shows a variation of the embodiment of FIG. 1 wherein an accelerator pump 16 is provided in the carburetor 1 with the accelerator pump being operatively connected to the throttle flap 30. The accelerator pump 16 includes a piston 36 which acts on the pump chamber 15 with the actuation of the throttle flap 30. From there, fuel is injected into the air channel 10 via a fuel nozzle 7 in a manner not shown. The fuel nozzle 7, which is assigned to the pump chamber 15, can be an accelerator nozzle or an idle nozzle 8 or main nozzle 13. The pump chamber 15 is flow-conductively connected to the control chamber 3 via a segment 19 of the return line 17 and forms an ancillary chamber 9 of the control chamber 3. The control chamber 3, the main nozzle chamber 14, the pump chamber 15 and the purge pump 11 are flow-conductively connected in series via the segment 19 of the return line 17. Depending upon the application, a flow-conducting parallel connection can be practical. The embodiment of FIG. 2 corresponds to that shown in FIG. 1 with respect to the remaining features and reference numerals.

Figure 3:
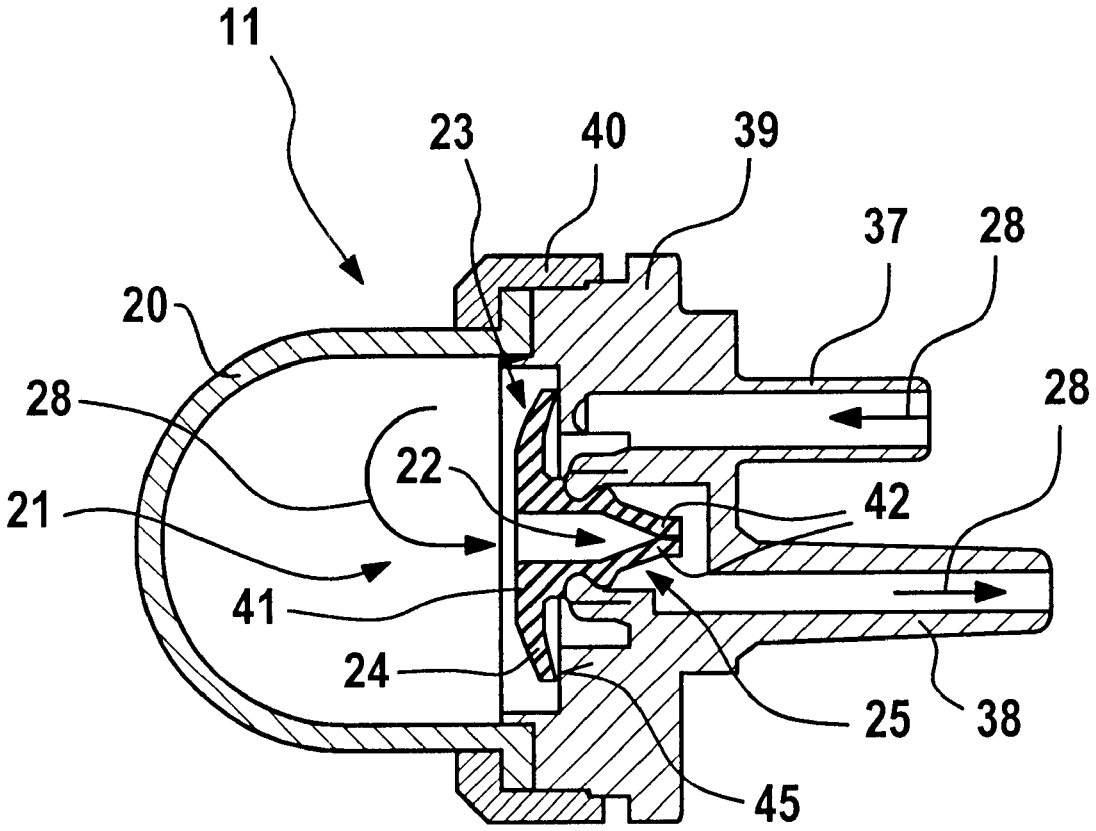
FIG. 3 is a section view of a purge pump having a duckbill valve.

FIG. 3 shows a purge pump 11 as a variation of the embodiment of FIGS. 1 and 2. The cross-sectional illustration shows a base body 39 having input and output stubs (37, 38) integrally formed thereon. An elastic pump bellows 20 is fixed on the base body 39 with a cap nut 40. The valve arrangement 21 includes an intake valve 23 for drawing by suction via the inlet stub 37 and a discharge valve 25 for discharging through the outlet stub 38. This valve arrangement 21 further includes a one-part rubber element 41 having an elastic valve plate 24 and two elastic lips 42 lying one against the other. The valve plate 24 lies against a valve seat 45 in the region of the inlet stub 37 and thereby forms the suction valve 23. The two lips 42 project into the region of the outlet stub 38 and are configured in the form of a duckbill valve 22 defining the discharge valve 25. The inlet stub 37 and the outlet stub 38 are configured for connecting hose lines, whereby the purge pump 11 can be positioned at a desired suitable location of the work apparatus. The illustrated purge pump 11 can also be configured so as to be integrated in the carburetor 1 in correspondence to the embodiment shown in FIGS. 1 and 2.

Figure 4:
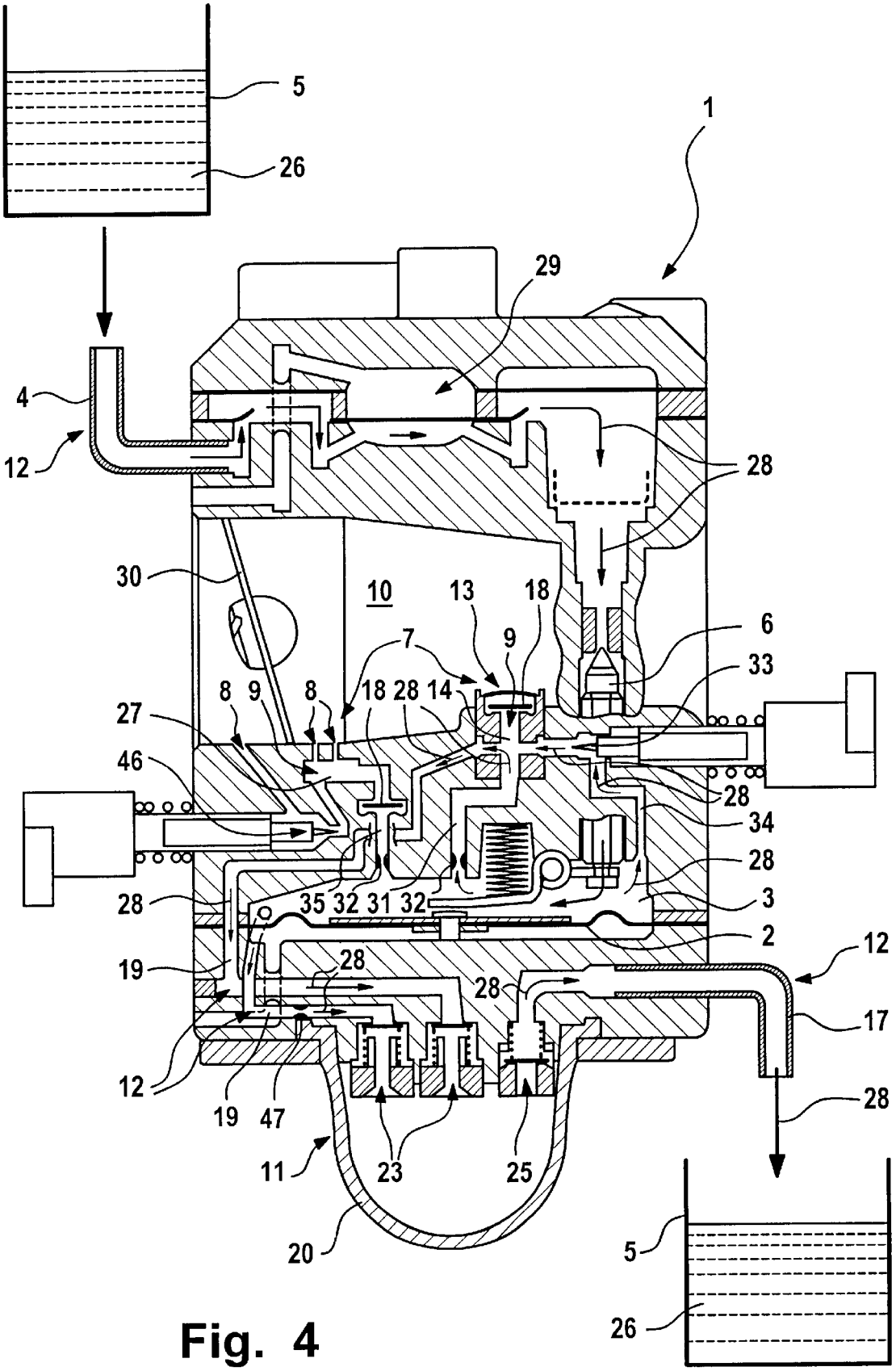
FIG. 4 is a further variation of the embodiment of FIG. 1 and includes a main nozzle chamber and a control chamber connected in parallel to each other.

FIG. 4 shows a further variation of the embodiment of FIG. 1 wherein the purge pump 11 includes two suction valves 23. One of the suction valves 23 is connected via a segment 19 of the fuel line 12 to the main nozzle chamber 14. The other suction valve 23 is connected via a further segment 19 directly to the control chamber 3 whereby a flow-conducting parallel connection of the control chamber 3 and the main nozzle chamber 14 is provided in the direction of the purge pump 11. To adapt the two component flows 28, a throttle 47 is provided in the segment 19 leading directly to the control chamber 3. The arrangement shown corresponds to the arrangement of FIG. 1 with respect to the remaining features and reference numerals.

It is understood that the foregoing description is that of the preferred embodiments of the invention and that various changes and modifications may be made thereto without departing from the spirit and scope of the invention as defined in the appended claims.

What is claimed is:

1. A membrane carburetor for an internal combustion engine in a portable handheld work apparatus including a motor-driven chain saw, cutoff machine and brushcutter, the engine having a fuel tank and the membrane carburetor comprising:

a carburetor housing defining an intake channel communicating with the engine and through which a stream of combustion air flowing in an intake flow direction is drawn by suction when the engine is operating;

said carburetor housing defining an interior space;

a control membrane mounted in said interior space so as to define a control chamber therein bounded by said control membrane;

a fuel supply line connecting said fuel tank to said control chamber;

a control valve mounted in said fuel supply line and being actuable to control the inflow of fuel to said control chamber;

said control membrane being operatively connected to said control valve for actuating said control valve to clear said fuel supply line in response to a deflection of said control membrane whereby fuel flows into said control chamber;

at least one fuel nozzle;

an ancillary chamber disposed in said carburetor housing;

a fuel path connecting said control chamber to said fuel tank;

a purge pump mounted in said fuel path;

said control chamber being connected to said intake channel via said ancillary chamber and said fuel nozzle;

said fuel path including a segment thereof between said control chamber and said purge pump; and, said fuel path being so configured that said segment thereof passes through said ancillary chamber.

2. The membrane carburetor of claim 1, wherein said fuel nozzle is a main nozzle and said ancillary chamber is a main nozzle chamber connected ahead of said main nozzle.

3. The membrane carburetor of claim 1, wherein said ancillary chamber is a pump chamber of an accelerator pump.

4. The membrane carburetor of claim 1, further comprising an accelerator pump having a pump chamber and a plurality of said ancillary chambers; and, said plurality of ancillary chambers and said pump chamber being flow-conductively connected in series.

5. The membrane carburetor of claim 4, wherein one of said ancillary chambers is a main nozzle chamber.

6. The membrane carburetor of claim 1, further comprising a plurality of said ancillary chambers flow-conductively connected in parallel in the direction of said purge pump.

7. The membrane carburetor of claim 1, wherein said ancillary chamber and said control chamber are flow-conductively in parallel in the direction of said purge pump.

8. The membrane carburetor of claim 1, wherein said fuel line is a return line wherein said purge pump is mounted as a suction pump operating on said control chamber.

9. The membrane carburetor of claim 8, further comprising a check valve mounted in the region of said ancillary chamber for acting on said fuel nozzle corresponding thereto.

10. The membrane carburetor of claim 9, wherein said check valve is mounted in said ancillary chamber.

11. The membrane carburetor of claim 1, wherein said control valve is on one side of said membrane carburetor; a portion of said segment of said fuel path connects said ancillary chamber to said purge pump; and, said portion of said segment is on said one side of said membrane carburetor.

12. The membrane carburetor of claim 1, wherein said purge pump includes an elastic depressable pump bellows.

13. The membrane carburetor of claim 1, wherein said purge pump includes a valve arrangement having at least one duckbill valve.

14. The membrane carburetor of claim 1, wherein said purge pump includes a valve arrangement; and, said valve arrangement includes a suction valve having a valve plate; and, a duckbill valve configured as a pressure valve.

15. The membrane carburetor of claim 14, wherein said valve plate and said duckbill valve are made as one piece of elastic material.

* * * * *